US007794252B2

(12) United States Patent
Sauer et al.

(10) Patent No.: US 7,794,252 B2
(45) Date of Patent: Sep. 14, 2010

(54) EXPLOSION-PROOF CONNECTOR INCLUDING A SOCKET PART AND A PLUG PART

(75) Inventors: Dieter Sauer, Heddesbach (DE); Reiner Naumann, Mannheim (DE); Gerhard Schwarz, Shoenbrum-Allemuehl (DE)

(73) Assignee: Cooper Crouse-Hinds GmbH, Soest (DE)

( * ) Notice: Subject to any disclaimer, the term of this patent is extended or adjusted under 35 U.S.C. 154(b) by 0 days.

(21) Appl. No.: 11/995,377

(22) PCT Filed: Jul. 11, 2006

(86) PCT No.: PCT/EP2006/006784

§ 371 (c)(1),
(2), (4) Date: Aug. 25, 2008

(87) PCT Pub. No.: WO2007/006554

PCT Pub. Date: Jan. 18, 2007

(65) Prior Publication Data

US 2008/0311774 A1 Dec. 18, 2008

(30) Foreign Application Priority Data

Jul. 12, 2005 (DE) ..... 20 2005 010 927 U

(51) Int. Cl.
*H01R 13/53* (2006.01)

(52) U.S. Cl. ..... 439/186; 439/181

(58) Field of Classification Search ..... 439/186, 439/180, 181, 321, 347, 142, 314, 138, 271; 361/2

See application file for complete search history.

(56) References Cited

U.S. PATENT DOCUMENTS 2,626,974 A * 1/1953 Howard et al. ..... 439/347

(Continued)

FOREIGN PATENT DOCUMENTS

DE 297 09 031 U1 8/1997

(Continued)

OTHER PUBLICATIONS

International Search Report (Application No. PCT/EP2006/006784) mailed Oct. 26, 2006; 3 pages.

(Continued)

*Primary Examiner*—Chandrika Prasad
(74) *Attorney, Agent, or Firm*—Fish & Richardson P.C.

(57) ABSTRACT

An explosion-proof connector (1) comprises a plug part (2) and a socket part (3), the plug part (2) comprising a plug housing (4) with at least two plug pins (6) arranged in a plug insert (5), and the socket part (3) comprising a socket housing (7) with matching socket contacts (9) arranged in a socket insert (8).

In order to simplify such an explosion-proof connector in a way that it can be handled more easily especially when disconnecting plug part and socket part while maintaining explosion proofness, one housing (4, 7) comprises an outer sleeve (10) which is detachably connectable to the other housing (7, 4), a first gap (11) being formed between outer sleeve (10) and other housing (7, 4) and a second gap (12) between outer sleeve (10) and associated insert (4, 8) already before electrically contacting plug pins (6) and socket contacts (9) for realizing type of protection d, flameproof enclosure, and type of protection e, increased safety, respectively.

25 Claims, 2 Drawing Sheets

U.S. PATENT DOCUMENTS

| | | | | | |
|---|---|---|---|---|---|
| 2,697,212 | A | * | 12/1954 | Castelli | 439/181 |
| 3,125,394 | A | * | 3/1964 | Appleton | 439/142 |
| 3,235,682 | A | * | 2/1966 | Papworth | 200/51.09 |
| 3,312,928 | A | * | 4/1967 | Nava et al. | 439/180 |
| 3,330,920 | A | * | 7/1967 | Appleton | 200/51.07 |
| 4,198,110 | A | * | 4/1980 | Wetmore et al. | 439/321 |
| 4,628,392 | A | * | 12/1986 | Didier | 361/2 |
| 6,382,990 | B1 | * | 5/2002 | Marechal et al. | 439/138 |
| 6,877,277 | B2 | * | 4/2005 | Kussel et al. | 49/314 |

FOREIGN PATENT DOCUMENTS

| | | | |
|---|---|---|---|
| DE | 199 04 037 | A1 | 8/2000 |
| DE | 200 13 819 | U1 | 1/2002 |
| EP | 1 202 399 | A2 | 5/2002 |
| FR | 2 705 502 | | 11/1994 |
| WO | 99/27615 | A1 | 6/1999 |

OTHER PUBLICATIONS

*ABB Flameproof Enclosure 'd'*, downloaded on Jun. 12, 2009, from http://www.abb.com/product/ap/seitp322/88a4f82cle586018c1256dd0003dc758.aspx

* cited by examiner

EXPLOSION-PROOF CONNECTOR INCLUDING A SOCKET PART AND A PLUG PART

CROSS-REFERENCE TO RELATED APPLICATIONS

This application is the National Stage of International Application No. PCT/EP2006/006784, filed on Jul. 1, 2006, which claims priority to German Application No. 10 2005 010 927.4, filed on Jul. 12, 2005.

TECHNICAL FIELD

The present invention relates to an explosion-proof connector comprising a plug part and a socket part, the plug part comprising a plug housing with at least two plug pins arranged in a plug insert, and the socket part comprising a socket housing with matching socket contacts arranged in a socket insert.

BACKGROUND

Such an explosion-proof connector is known from DE 200 13 819. To be able to separate plug part and socket part in a hazardous area from each other also without a corresponding voltage being switched off, the electrical contacting between plug pins and socket contacts is already interrupted before the separation proper of plug part and socket part and their housings, respectively. The plug housing is here designed such that it is held in a retaining position before full separation and a substantially outwardly sealed inner chamber is formed in such a retaining position between the housings and plug pins and sockets contacts, respectively.

SUMMARY

Such an explosion-proof connector is easily usable in hazardous areas and reliably prevents a situation in which sparks that might occur upon separation of the corresponding contact elements ignite an explosive medium that is present in the hazardous area.

With respect to DE 200 13 819 it is the object of the present invention to improve an explosion-proof connector by way of simple constructional measures such that it can be handled more easily especially when disconnecting plug part and socket part while maintaining explosion proofness.

This object is accomplished by the features of claim 1.

According to the invention one of the housings of plug part and socket part, respectively, comprises an outer sleeve. Said sleeve is detachably connectable to the other housing, a first gap being formed between outer sleeve and the other housing and a second gap between outer sleeve and associated insert, i.e. plug insert and socket insert, respectively, already before electrically contacting or after disconnecting the contacting of plug pins and socket contacts so as to realize type of protection d, flameproof enclosure, and type of protection e, increased safety, respectively.

It is thereby possible to establish the connection between plug part and socket part in any easy way by using the outer sleeve, and explosion proofness is guaranteed on the other hand by the two gaps in a safe way because the interior of the connector that is possibly filled with an explosive medium is only in contact with the exterior of the connector via said gaps.

To be able to establish a simple detachable connection between outer sleeve and the other housing of the connector, the outer sleeve may be configured as a screw sleeve with inner thread as viewed from its screw-on end. The corresponding first gap is formed between said inner thread and the other housing.

It is possible that the outer sleeve or screw sleeve, respectively, is part of the plug part. However, handling while connecting or disconnecting plug part and socket part is simplified if the outer sleeve is part of the socket housing and supported to be rotatable relative to the socket insert. Attention must here be paid that the corresponding socket part is normally fixedly arranged on a means in the hazardous area and that the matching plug part can be moved towards and connected to the socket part because of e.g. a movable cable connection.

To electrically insulate the various socket contacts in a safe way relative to one another on the one hand and, at the same time also for use in hazardous areas, to be able to connect the same to corresponding electrical contact elements, the socket insert may be made from a plastic material and cast especially in tight and flameproof fashion around socket contacts and their electrical contacting elements. Such electrical contacting elements are e.g. a cable with contact wires arranged therein.

To form also the second gap in a safe way especially with respect to gap width and gap shape, the socket insert may comprise a metal ring on its outside facing the sleeve inside of the outer sleeve and the second gap may be formed between said ring and the sleeve inside.

In a further embodiment, the socket insert and the plug insert, respectively, may be formed form a plastic material and the socket contacts and the plug pins, respectively, are supported to be movable with formation of an explosion-proof gap in said material. This results in an embedment floating at one side, either pins or contacts, which is also possible if attention is paid to the maximum gap widths according to the relevant rules. The manufacturing tolerances can then be compensated radially through such play.

A radial compensation can also be accomplished through a resilient contact in the interior of the socket contacts.

A simple formation of a corresponding gap is accomplished in that the socket insert on its outside facing the sleeve inside forms the second gap in a defined area directly with the sleeve inside.

Moreover, to fix the metal ring exactly relative to the socket insert, the socket insert may be provided in the area of the metal ring with a radially outwardly projecting annular flange on which a horizontal T-web is located with its bottom side facing away from the sleeve inside. The corresponding annular flange may here extend in the longitudinal direction of the socket insert at a length corresponding to the horizontal T-web.

To captively arrange the screw sleeve in a simple manner on the socket insert, the inner thread of the screw sleeve may extend from the screw-on end up to the metal ring. The thread, for instance, prevents the screw sleeve from slipping off by contact with the metal ring, the rotatable support of the screw sleeve being e.g. possibly created by a radially inwardly projecting annular flange which extends up to the outside of the socket insert.

The corresponding metal ring may be arranged in this context between the inner thread of the screw sleeve and the corresponding annular flange.

To configure the plug housing also in a simple way, said housing may be substantially cup-shaped with an outer thread as viewed from the free end. The plug housing can then be inserted into the screw sleeve and detachably connected thereto by screwing. The first gap is thereby formed between the threads.

To achieve a condition in which the corresponding first gap is already formed before the electrical contacting of plug pins and socket contacts, the socket insert extends to a correspondingly great extent in the direction of the plug pins, so that the pins are already inserted into inner bores of the socket insert upon establishment of the threaded engagement between screw sleeve and plug housing, but are not yet inserted via said inner bores up to the socket contacts for electrical contacting.

It is of advantage in connection with explosion proofness when plug housing and outer sleeve are made from metal at least in the area of the thread. This applies by analogy to the outer sleeve in the area of the metal ring, which outer sleeve may also be made from metal in said area.

To electrically insulate the plug pins in a simple way relative to a plug housing of metal, an insulating sleeve may be arranged as the plug insert at least between plug housing and plug pins.

To be able to electrically contact the plug pins inside the insulating sleeve in a simple and safe way, a plastic material may be cast in tight and flameproof fashion between insulating sleeve and electric feed lines leading to the plug pins.

To be able to connect other means to the plug part in a simple way, if necessary, the plug housing may comprise a screw end opposite its free end, through which electric feed lines are passed and in which the electric feed lines are cast with the plastic material in tight and flameproof fashion.

To permit a simple assignment of plug pins and socket contacts in handling the connector, the free end of the plug housing may end flush with ends of the plug pins. The plug pins are here clearly visible during handling and can be assigned in a simple way to the corresponding inner bores of the socket insert and the socket contacts, respectively. This assignment can be further simplified in that the socket insert projects from the screw-on end of the screw sleeve.

The connector according to the invention may in principle be made from plastics with inserted metal parts for gap formation, from an all-plastic material or also with the help of metallic threaded sleeves. In one example the thread-carrying parts are made from a metallic material and the inner parts from an insulating plastic material. An all-plastic version of the complete connector is also possible. Attention must just be paid that the current-conducting parts are embedded in an insulated form in conformity with the relevant rules.

DESCRIPTION OF THE DRAWINGS

The present invention will now be described in more detail in the following with reference to an embodiment shown in the figures, of which.

DETAILED DESCRIPTION

Figure 1:
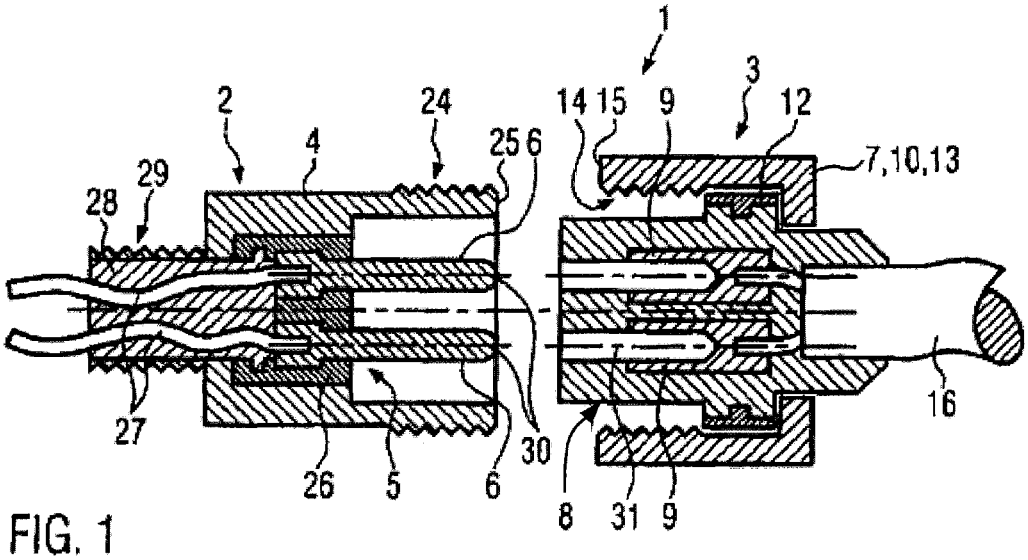
FIG. 1 is a longitudinal section through an explosion-proof connector according to the invention with plug part and socket part being separated from each other.

FIG. 1 shows a connector 1 according to the invention in longitudinal section. The connector 1 comprises a plug part 2 and a socket part 3, which are spaced apart from each other in FIG. 1. The plug part 2 comprises an approximately cup-shaped plug housing 4 made from metal. Next to its free end 25, the plug housing 4 has an outer thread 24. On its screw end 29 opposite the free end 25, the plug housing 4 comprises a section of reduced diameter which also comprises an outer thread. In this screw end 29, a plastic material 28 is cast in tight and flameproof fashion and surrounds electric feed lines 27. These extend through the cast-in plastic material 28 up to the plug pins 6 to contact the same electrically. The plastic material 28 is arranged in the area of the corresponding ends of the plug pins 6 in an insulating sleeve 26 as a plug insert 5 made of an electrically insulating plastic material, the corresponding insulating sleeve 26 also surrounding the associated ends of the plug pins 6 and electrically insulating the same relative to one another.

The plug pins 6 extend from the insulating sleeve 26 towards the free end 25 of the plug housing 4. At said place they end flush with the free end 25.

The socket part 3 comprises an outer sleeve 10 as the socket housing 7. Said outer sleeve 10 is provided on its sleeve inside 17, see also FIG. 2, with an inner thread 14 which extends from a screw-on end 15 up to a metal ring 19. At its end opposite the screw-on end 15 the outer sleeve 10 comprises a radially inwardly projecting annular flange which serves the rotatable support of the outer sleeve 10 relative to the socket insert 8. Said socket insert 8 is made from a plastic material and cast in tight and flameproof fashion both with socket contacts 9 and the electrical contacting elements 16 for said socket contacts. In the area of the metal ring 19, see also FIG. 2, the socket insert 8 is provided on its outside 18 with a radially outwardly projecting annular flange 22. A bottom side 23 of the metal ring 19 is in contact with said flange. The metal ring 19 is substantially T-shaped having a horizontal T-web 20 and a vertical T-web 21. The horizontal T-web 20 shows the corresponding bottom side 23, and corresponding plastic material is also cast around the vertical T-web 21 for attachment to the socket insert 8.

Figure 2:
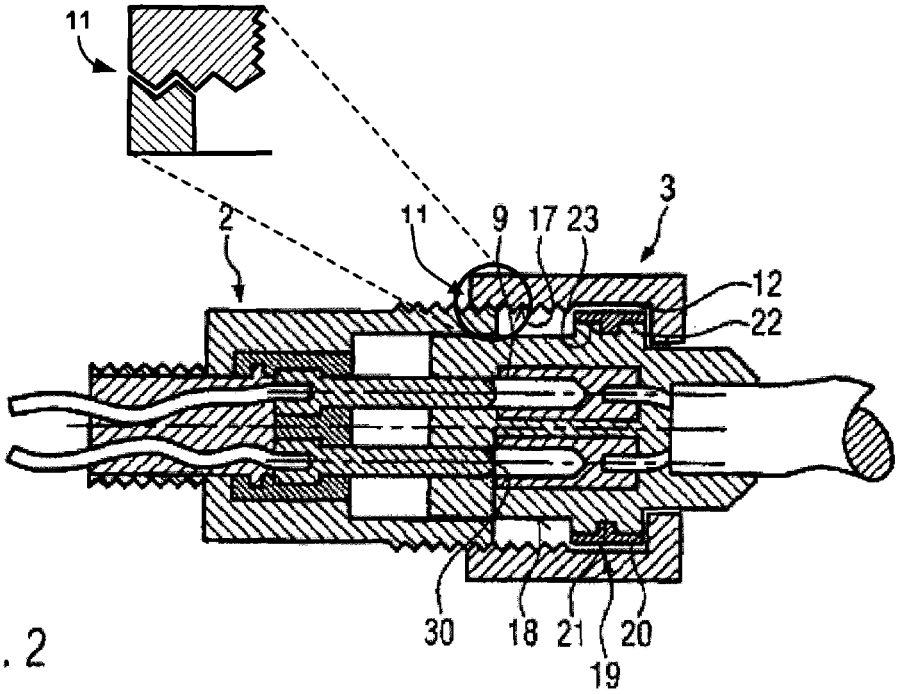
FIG. 2 is a longitudinal section by analogy with FIG. 1 with the plug part being inserted in part into the socket part.
Figure 3:
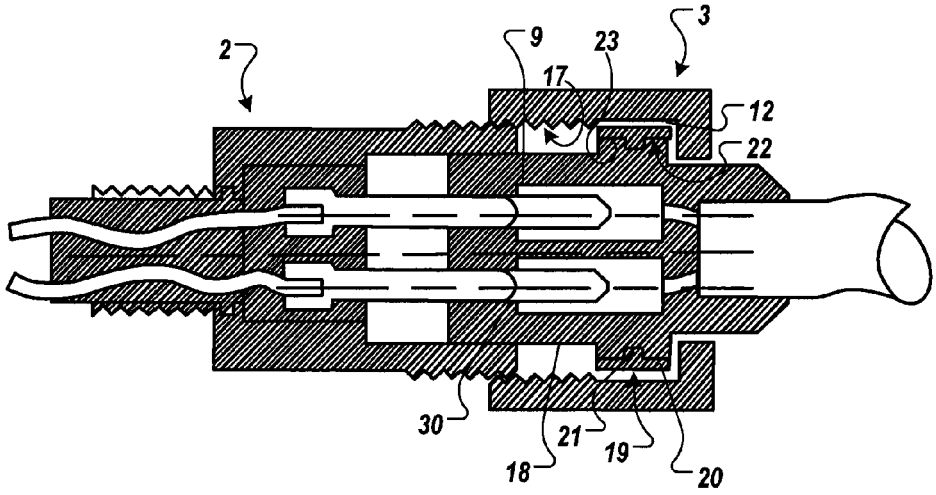
FIG. 3 is a longitudinal sectional view of the connector fabricated as an all-plastic type connector.

A second gap 12 is formed between the sleeve inside 17 and the upper side of the horizontal T-web 20, and a first gap 11, see again FIG. 2, is formed between outer thread 24 of the plug part 2 and plug housing 4, respectively, and the inner thread 14 of the outer sleeve 10. The two gaps are defined in both cases by corresponding metallic surfaces and prevent breakthrough of a spark possibly generated in the interior of the connector 1. As a result, the connector according to the invention can be used in hazardous areas, the gaps 11, 12 meeting the criteria regarding explosion-proof enclosure d or increased safety e, respectively.

In comparison with the plug pins 6 the socket insert 8 has arranged therein a corresponding number and arrangement of socket contacts 9. Inner bores 31 of the socket insert 8 that are open towards the plug pins 6 terminate in said contacts.

In FIG. 2, the plug pins 6 are inserted at least into said inner bores 31 without an electrical contact being already established between plug pins 6 and socket contacts 9. In this partly inserted position of plug part 2 and socket part 3, the corresponding gaps 11 and 12 have already been formed without current flowing yet.

The connection of plug part 2 and socket part 3 is established through the outer sleeve 10 which is formed as a screw sleeve 13 and which is screwed by means of its inner thread 14 onto the outer thread 24 of the plug housing 4. It is only upon further screwing of the screw sleeve 3 onto the plug housing 4 that plug pins 6 and socket contacts 9 are further approaching each other until finally the ends 30 of the plug pins 6 get into contact with the metallic socket contacts 9 for establishing an electrical connection. After completion of the screwing-on operation the plug pins are inserted as far as possible into the socket contacts 9. The inserting operation can be performed until contact of the free end 25 with the radially outwardly projecting annular flange 22 or the metal ring 19, respectively. To this end the inner thread 14 of the screw sleeve 13 extends accordingly from the screw-on end 15 up to about the metal ring 19.

The socket insert 8 is also formed from a plastic material which is cast in tight and flameproof fashion around the socket contacts 9 and the associated electrical contacting elements 16 in the form of e.g. a cable.

According to the invention it is possible to particularly disconnect an electrical connection between plug part and socket part—also without disconnection from the power supply—by means of the explosion-proof connector according to the invention without skilled personnel being needed for disconnecting such connections. For this purpose it must be ensured that prior to the establishment of or after disconnection of the electrical connections between plug pins and socket contacts a connection is already established or still exists between the corresponding housings of the connector parts, with a contact being only present through the first and second gap from the interior of the connector to the outside of the connector, whereas all of the other parts of the connector are enclosed in tight and flameproof fashion by corresponding plastic material.

The connector is here assembled in the first step by means of two threads that are screwed into each other. This screwing operation creates a flameproof enclosure of the space in which the contact elements are arranged. Contacting on pins and contacts is carried out by further rotation. Arcs possibly created thereby can ignite the gases that might be present in the interior of the enclosure, but the defined gaps and the mechanical stability of the flameproof enclosure prevent ignition of the surrounding gaseous atmosphere.

What is claimed is:

1. An explosion-proof connector comprising a plug part and a socket part, the plug part comprising a plug housing with at least two plug pins arranged in a plug insert, and the socket part comprising a socket housing with matching socket contacts arranged in a socket insert, wherein one of the socket housing and the plug housing forms an outer sleeve, which is detachably connectable to the other of the socket housing and the plug housing, a first gap being formed between the outer sleeve and the other housing and a second gap between the outer sleeve and associated insert already before electrically contacting plug pins and socket contacts for realizing type of protection "d", flameproof enclosure, and type of protection "e", increased safety, respectively, and the second gap providing a passage between an interior of the connector and an exterior of the connector.

2. The explosion-proof connector according to claim 1, wherein the outer sleeve is configured as a screw sleeve with an inner thread as viewed from its screw-on end.

3. The explosion-proof connector according to claim 1, wherein the outer sleeve is part of the socket housing and supported to be rotatable relative to the socket insert.

4. The explosion-proof connector according to claim 1, wherein the socket insert is made from a plastic material and is cast especially in tight and flameproof fashion around socket contacts and the electrical contacting elements thereof.

5. The explosion-proof connector according to claim 1, wherein the socket insert is made from a plastic material and the socket contacts are movably supported therein with formation of an explosion-proof gap.

6. The explosion-proof connector according to claim 4, wherein the plug insert is made from a plastic material and the plug pins are movably supported therein with formation of an explosion-proof gap.

7. The explosion-proof connector according to claim 4, wherein the socket insert comprises a metal ring on its outside facing the sleeve inside and the second gap is formed between said ring and the sleeve inside.

8. The explosion-proof connector according to claim 7, wherein on its outside facing the sleeve inside the socket insert forms the second gap in a defined area directly with the sleeve inside.

9. The explosion-proof connector according to claim 7, wherein the socket insert in the area of the metal ring comprises a radially outwardly projecting annular flange on which a horizontal T-web rests with its bottom side oriented away from the sleeve inside.

10. The explosion-proof connector according to claim 9, wherein the inner thread of the screw sleeve extends from the screw-on end to the metal ring.

11. The explosion-proof connector according to claim 10, wherein the plug housing is configured to be substantially cup-shaped with outer thread as viewed from the free end.

12. The explosion-proof connector according to claim 10, wherein plug housing and outer sleeve are made from metal at least in the area of the thread.

13. The explosion-proof connector according to claim 1, wherein an insulating sleeve is arranged as plug insert at least between plug housing and plug pins.

14. The explosion-proof connector according to claim 13, wherein a plastic material is cast in tight and flameproof fashion between insulating sleeve and electric feed lines guided to the plug pins.

15. The explosion-proof connector according to claim 14, wherein the plug housing comprises a screw end opposite its free end, through which the electric feed lines are passed and cast with the plastic material in tight and flameproof fashion.

16. The explosion-proof connector according to claim 11, wherein the free end of the plug housing ends flush with ends of the plug pins.

17. The explosion-proof connector according to claim 2, wherein the socket insert projects from the screw-on end of the screw sleeve.

18. The explosion-proof connector according to claim 2, wherein the thread-carrying parts are made from a metallic material and the inner parts from an insulating plastic material.

19. The explosion-proof connector according to claim 1, wherein the complete connector is fabricated as an all-plastic type.

20. The explosion-proof connector according to claim 5, wherein the plug insert is made from a plastic material and the plug pins are movably supported therein with formation of an explosion-proof gap.

21. The explosion-proof connector according to claim 5, wherein the socket insert comprises a metal ring on its outside facing the sleeve inside and the second gap is formed between said ring and the sleeve inside.

22. The explosion-proof connector according to claim 11, wherein plug housing and outer sleeve are made from metal at least in the area of the thread.

23. The explosion-proof connector according to claim 10, wherein the thread-carrying parts are made from a metallic material and the inner parts from an insulating plastic material.

24. The explosion-proof connector according to claim 11, wherein the thread-carrying parts are made from a metallic material and the inner parts from an insulating plastic material.

25. The explosion-proof connector according to claim 1, wherein the first gap provides a second passage between an interior of the connector and an exterior of the connector.

* * * * *